United States Patent [19]

Broutman

[11] 4,321,221

[45] Mar. 23, 1982

[54] PROCESS FOR CONTINUOUS PRODUCTION OF THERMOSETTING RESINOUS FIBERS

[76] Inventor: Lawrence J. Broutman, 1037 Edgebrook La., Glencoe, Ill. 60022

[21] Appl. No.: 157,652

[22] Filed: Jun. 9, 1980

[51] Int. Cl.[3] ..... B06B 3/00

[52] U.S. Cl. ..... 264/23; 264/83; 264/169; 264/176 F; 264/236

[58] Field of Search ..... 264/23, 176 F, 236, 264/83, 169

[56] References Cited

U.S. PATENT DOCUMENTS

| | | | |
|---|---|---|---|
| 2,376,511 | 5/1945 | Saunders et al. | 264/176 F |
| 2,802,237 | 8/1957 | Davis | 264/169 |
| 2,954,271 | 9/1960 | Cenzato | 264/23 |
| 3,042,481 | 7/1962 | Coggeshall | 264/23 |
| 3,619,429 | 11/1971 | Torigai et al. | 264/174 |
| 3,651,199 | 3/1972 | Blume et al. | 264/236 |
| 3,723,588 | 3/1073 | Economy et al. | 264/83 |
| 3,848,044 | 11/1974 | Hagiwana et al. | 264/236 |
| 4,008,304 | 2/1977 | Kyoyama et al. | 264/236 |
| 4,076,692 | 2/1978 | Batha et al. | 264/176 F |
| 4,115,364 | 9/1978 | Kimura et al. | 264/176 F |
| 4,124,666 | 11/1978 | Wilhelm et al. | 264/176 F |
| 4,178,336 | 12/1979 | Snowden | 264/236 |

FOREIGN PATENT DOCUMENTS

| | | | |
|---|---|---|---|
| 46-33404 | 9/1971 | Japan | 264/33 |
| 48-28007 | 8/1973 | Japan | 264/236 |
| 48-75818 | 10/1973 | Japan | 264/236 |
| 49-19121 | 2/1974 | Japan | 264/169 |
| 49-47614 | 5/1974 | Japan | 264/236 |

*Primary Examiner*—Jay H. Woo

*Attorney, Agent, or Firm*—McDougall, Hersh & Scott

[57] ABSTRACT

The preparation of cured thermosetting resinous fibers for extruding a dried novoloc resin in admixture with a crosslinking agent to a gear pump having a spinnerette connected thereto for issuance of the molten resin from the spinnerette into an atomsphere of an acid gas for cure of the resinous fibers issuing from the spinnerette.

16 Claims, 2 Drawing Figures

PROCESS FOR CONTINUOUS PRODUCTION OF THERMOSETTING RESINOUS FIBERS

This invention relates to a new rapid method of production for cured thermosetting resinous fibers.

The term cured thermosetting resinous fibers is meant to include fibers formed of such thermosetting resinous or polymeric materials as represented by phenol formaldehyde and other phenol-aldehyde resins, melamine and urea formaldehyde resins, epoxy resins and the like. It is understood that these resins form the principal constituent of the fiber but that other important constituents may be present such as polyamides (nylon 6,6) in the case of the phenol formaldehyde resin fiber.

Procedures for conversion of phenolic novolac resins into cured fibers are well-known. U.S. Pat. No. 3,650,102 describes such a fiber forming process. It is most desirable to manufacture phenolic resin fibers beginning with novolac phenolic resins, i.e., those phenolic resins manufactured from phenol and formaldehyde wherein excess phenol is used. The novolac resins are preferred due to their ease of manufacture and control and in addition, it is somewhat easier to cure novolac resins in the fiber form. In the fiber forming process described by U.S. Pat. No. 3,650,102, a phenolic novolac resin in a thermoplastic state (A or B stage) is reduced to a molten or plastic stage and formed into fibers by a conventional fiberizing technique, e.g., melt spinning. The novolac fibers are then converted to the cured, infusible, stage by heating the fibers, preferably in the presence of formaldehyde and an acid catalyst. These constituents diffuse into the fiber, and with proper temperatures and times, advance the molecular weight of the novolac and crosslink the molecules to obtain infusible, cured phenolic fibers.

This method of manufacture of phenolic resin fibers takes considerable time, generally running from 6 to 16 hours, from the time the process begins until the cured phenolic resin fiber is obtained.

A more rapid method of manufacture of phenolic resin fibers has been described in U.S. Pat. No. 4,076,792. In this invention, uncured novolac resin is blended with 3 to 12 percent by weight of a novolac crosslinking agent from the group consisting of hexamethylenetetramine and/or paraformaldehyde. This blending is accomplished in a commercial blending apparatus, such as a ball mill. The resin which is to be fiberized is melted just prior to the fiberizing process, that is, the time between melting and fiberizing is generally from about 1 to 15 seconds. The quick fiberizing is required in order to avoid premature curing. In a particular method of fiber forming the resin particles blended with crosslinking agent is centrifugally forced through orifices in a cylinder which is heated sufficiently rapidly to melt the resin. The cylinder is rotated at sufficient speed to cause fibers to be pulled through the orifices by centrifugal force. As an example of such a process described in U.S. Pat. No. 4,076,692, utilization is made of a cotton candy machine to provide for the fiberizing by centrifugal force. All other examples, including that of the application of centrifugal force are suited only for the production of blown or short, discontinuous fibers.

Upon forming the fibers, they are rapidly cured by heating in an acidic vapor at from about 20° C. to above 300° C. and at from about 1 to about 10 atmospheres of pressure. The curing time for complete cure of the fibers is less than 10 minutes and usually less than 5 minutes.

BRIEF DESCRIPTION OF THE INVENTION

Figure 1:
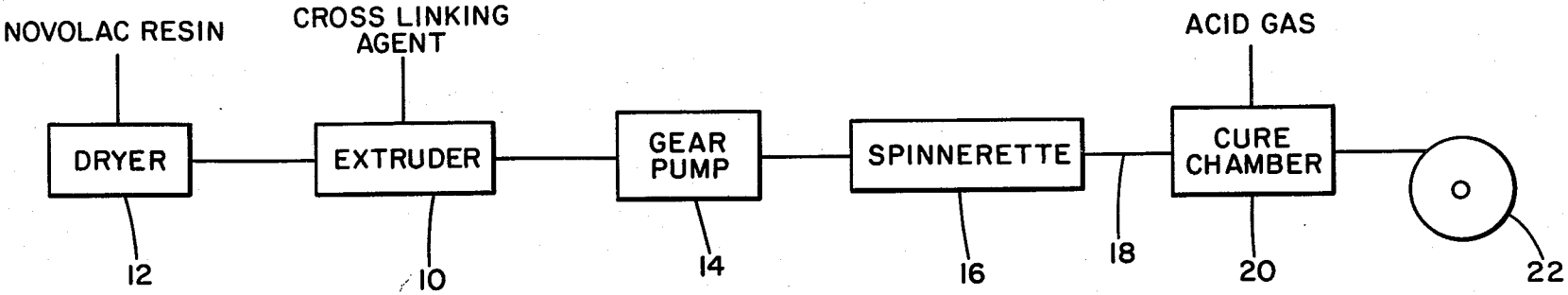
FIG. 1 is a flow diagram for the formation of continuous fibers.
Figure 2:
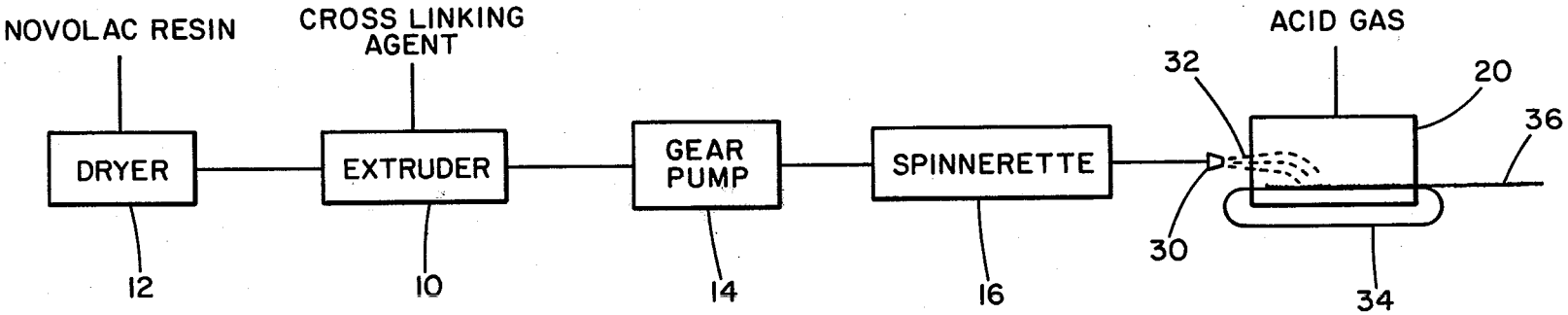
FIG. 2 is a flow diagram for the formation of discontinuous fibers.

This invention described here is a process for continuous rapid production of continuous or blown (short, discontinuous) cured thermosetting resinous fibers, such as phenol formaldehyde resinous fibers. An uncured novolac resin preblended with from about 3 to 15 weight percent of a novolac crosslinking agent desirably selected from the group consisting of hexamethylenetetramine and paraformaldehyde, is continuously melted in an extruder (single or twin screw). The blend is fed through the extruder at a temperature of from about 95° to 150° C. Other additives (e.g., additional curing agent or solvent) may be added between the feed section and extruder output end or die section. The blended phenolic resin is discharged into a gear pump to which the spinnerette is attached and the temperature of the metal is maintained from about 95° to 150° C. while the blended resin is fiberized by melt spinning or solution spinning if solvent is added during the mixing and extrusion. The uncured fibers emerging from the die are cured by contacting them with acidic vapor and/or formaldehyde at from about 20° to about 300° C. and from 1 to about 10 atmospheres of pressure until desired degree of curing is obtained.

DETAILED DESCRIPTION OF INVENTION

In order to continuously form a phenolic resin novolac containing curing agent into a thermosetting fiber, it must be able to be extruded through a die or spinnerette before significant crosslinking or curing results. This requires control of the novolac characteristics as well as the temperature and time history of the novolac from the time it enters the extruder or other suitable mixing device until it is extruded through the orifices of the die or spinnerette.

Novolac resins which may be used in the practice of this invention are well known to the skilled in the art and are readily available commercially. In general, such novolac resins are thermoplastic soluble phenol-aldehyde resins in which the phenol and aldyhyde are polymerized in the presence of an acid catalyst and/or with an excess phenol.

The most desirable type of phenolic resin for fiber formation from a commercial standpoint, due to its ease of formation and availability, is a novolac formed from phenol and formaldehyde wherein excess phenol is used. Crosslinking agents which may be used in conjunction with the uncured novolac to form a novoloid are hexamethylenetetramine (hexa), paraformaldehyde and cyclic formals, such as dioxolanes and dioxanes. The preferred crosslinking agents are hexa and paraformaldehyde.

Those novolac resins which are particularly suitable for use in accordance with this invention provide maximum curing times at necessary extrusion temperatures and provide reasonable viscosities for fiberizing at the lowest temperatures possible so as to lengthen curing times. Thus, novolac resins having number average molecular weights ranging from 300 to 800, preferably 300 to 500 gm/gm. mole, and melting points between 90° and 110° C. are preferred. In addition, moisture contents should be controlled so as to increase curing times and control viscosity and should be less than 1 percent, preferably less than 0.3 percent.

The blending of the uncured novolac resin with the crosslinking agent can be done in any commercial blending apparatus, such as a ball mill. This blended resin is fed into the hopper or feed section of an extruder, preferably a twin screw extruder. Alternately, the novolac by itself can be fed into the feed section of an extruder and the curing agent by itself or in a high concentration in the novolac can be fed downstream through an opening in the extruder. This latter technique reduces the residence time in the extruder for the blended material at elevated temperature and extends the total working time available for fiber forming without curing of the resin. When hexa is used, as representative of such crosslinking agents, the amount employed is generally in the range of 3 to 15 percent by weight of the resin. When the crosslinking agent is paraformaldehyde, it is preferred to make use of between 3 and 10 percent by weight.

The blended resin is maintained at constant temperature in the extrusion device through fluid temperature control of the barrel and screw, or screws, in the case of a twin screw extruder. The temperature of the molten phenolic resin is preferably maintained at a temperature between 110° C. and 130° C. as it is conveyed towards the exit end of the extruder. A filter can be provided at the exit end of the extruder from which the molten resin is fed directly into a gear pump in order to control the flow and pressure of the polymer as it enters the spinnerette. The molten phenolic resin which is conveyed by the gear pump to the spinnerette is maintained at a temperature between 110° and 130° C., dependent somewhat on the novolac molecular weight and hexa content, to prevent curing of the resin as it flows through the orifice.

In addition to controlling the resin viscosity by temperature, moisture content, resin molecular weight and hexa content, a compatible solvent or plasticizer can be blended into the molten phenolic resin as it is conveyed through the extruder. For example, solvents such as cyclohexanone, p-xylene or acetone can be pumped into the extruder, or plasticizers such as glycerol monostearate or various phthalate esters can be pumped into the extruder for admixture with the molten resin. The addition of solvents or plasticizers reduces the viscosity and allow the extrusion and fiberizing to be conducted at lower temperatures, with corresponding increase in the curing times or to delay cure. The addition of solvents, blended through the extruder, enables the fiber to be formed by a solution spinning rather than melt spinning, although the gear pump and spinnerette are still utilized.

After the fibers are formed, they are cured by contacting them with an acidic gas or vapor at from about 20° to about 300° C. and at from about 1 to about 10 atmospheres of pressure. The acidic gas may either be the gas of a conventional hydrogen containing acid such as HCl, HBr or a Lewis acid such as $BF_3$. Cure should be carried out at a temperature above about 100° C. but below decomposition temperature of the organic resinous component. The most desirable curing temperature is between about 100° and 250° C. so that a rapid complete cure is obtained in minimal time while decomposition and undesirable melting of the resin is avoided. The curing time for complete cure of the fibers will be less than 10 minutes.

In addition to heating the fibers in an atmosphere of acidic gas or vapor to cause cure without fiber fusion, the fibers may be heated in the presence of formaldehyde or paraformaldehyde vapors with an acid catalyst to also cause rapid curing of the surface and stabilization of the fiber prior to complete curing of the fiber cross-section. In this manner, the fiber surface chemistry is also altered by increasing the concentration of methylol groups due to reaction with excess formaldehyde. Without the formaldehyde cure, crosslinking occurs by methylene bridges in the case of the hexa cured material. Thus, the fiber surface chemistry can be altered by the final method of cure. This is significant with respect to the ability of the fiber to serve as a reinforcement for various other materials, such as plastics, rubber, cement, etc.

In accordance with the practice of this invention, either continuous fibers or blown short fibers can be equally produced. In the case of continuous fibers, the emerging fiberized novolac is taken up on textile winding equipment and strands are formed with the number of filaments per strand depending on the number of orifices in the spinnerette. Blown fibers can be prepared by blasting the molten resinous material with a high velocity heated air or gas stream as it issues from the spinnerette whereby the resinous material is drawn into filaments and broken into short fibers.

When a plasticizer or particularly a solvent is added to the phenolic novolac, the solvent is primarily evaporated from the fiber prior to complete cure. The curing of the fiber is accomplished as described above and it is desirable to remove the solvent prior to complete cure when the diffusion rates are still acceptable. This can be accomplished by slightly reducing the cure temperatures and extending the cure times.

When the novolac is preblended with a curing agent, curing will proceed unless temperatures and times are accurately controlled during the extrusion and spinning process. It is desirable though not essential in such case to minimize the contact of the molten polymer stream with the walls of the orifices in the spinnerette. This can be accomplished by the use of ultrasonic vibration of the spinnerette in a frequency range of 10,000 Hz to 30,000 Hz. Small amplitude vibrations at high frequencies will minimize the coefficient of friction, thus heat build up as well, and will also minimize the contact between the polymer and orifice wall. Another design change is to use a sintered metal to form the orifice wall and to force an inert gas (e.g., nitrogen or argon) through the orifice wall so as to create a pressure inside the orifice. Thus, the molten novolac will flow through each orifice but will be compressed so as to reduce its tendency to contact the orifice wall. This technique can also include the use of acidic gases rather than inert gases so as to stabilize or cure the fiber surface as it passes through the spinnerette. Furthermore, formaldehyde solutions can be pumped through the spinnerette for the same purpose.

EXAMPLES

EXAMPLE 1

A novolac resin (Monsanto Resinox 754) having an average particle size smaller than 200 mesh is blended with about 8 percent of hexamethylenetetramine in an extruder 10. This resin is first dried in a drier 12 to a moisture content of less than 0.3 wt. percent and fed into a twin screw extruder 10 (Werner-Pfleiderer, ZSK-53) having a filter at the exit and whereby the resin is melted and conveyed to a gear pump 14 at a temperature of 120° C. The resin is metered to the gear pump and then extruded through the spinnerette 16 at a temperature not exceeding 125° C. The resulting fibers 18 are exposed to a cure chamber 20 to 100 percent $BF_3$ gas at a maximum temperature of 180° C. at a pressure of 1 atmosphere until cured. The resulting fibers which are completely cured in 10 minutes are wound upon a reel 22.

EXAMPLE 2

The novolac resin from Example 1 is fed into the extruder without having been preblended with hexa. Upon melting of the novolac at a temperature of 125° C. in the extruder, the hexa is metered into the extruder to be mixed with the melted novolac. The metering is adjusted to provide a hexa content of 10 wt. percent. The resin is filtered and metered to the gear pump at a temperature not exceeding 125° C. Fibers are formed and cured as in Example 1.

EXAMPLE 3

An oxalic acid catalyzed novolac resin (Durez 31044) having an average particle size smaller than 200 mesh is dried to a moisture content less than 0.3 wt. percent. This resin is fed into the extruder and heated to a temperature of 120° C. Cyclohexanone solvent (10 wt. percent) is pumped into the extruder and mixed with the molten polymer to reduce its viscosity. This polymer is fed to the spinnerette as in Example 1. The fibers are maintained at 100° C. for from 5 to 10 minutes to aid in the solvent evaporation and then fully cured according to Example 1 in less than 10 minutes.

EXAMPLE 4

An oxalic acid catalyzed novolac resin as in Example 1, is delivered to the spinnerette. Upon emerging from the spinnerette, the molten resin is blasted by a stream of air issuing from nozzles 30 at a temperature of about 100° C. whereby the molten resin is attenuated into fine discontinuous fibers 32 which are collected as a felt 36 on a moving belt 35 at the bottom of a curing chamber 20. The fibers have an average length of less than ½ inch. The fibers are cured in the presence of 100 percent $BF_3$ gas or HCl gas at a pressure of 1 atmosphere and at a maximum temperature of 180° C. Complete cure occurs in less than 10 minutes.

I claim:

1. The method for the continuous production of thermosetting resinous fibers comprising:

introducing a novolac resin into an extruder in which the novolac resin has a moisture content that does not exceed 1% by weight, introducing a cross linking agent into the extruder for admixture with the novolac resin, extruding the mixture at a temperature within the range of 95°–150° C., transporting the resinous material in a molten state directly from the outlet from the extruder to a metering pump, conveying the molten resinous material under pressure from the metering pump to a spinnerette for issuance therefrom as a fibrous stream, subjecting the spinnerette to ultrasonic vibration to minimize the coefficient of friction and contact between the walls of the spinnerette and the molten resin while being processed therethrough, exposing the fibrous stream issuing from the spinnerette to cure in an atmosphere of a curing agent in a vapor state selected from the group consisting of an acid vapor or gas, formaldehyde and paraformaldehyde and mixtures thereof at a pressure withing the range of 1–10 atmospheres for cure of the resinous fibers.

2. The process as claimed in claim 1 which includes the step of drying the novolac resin to a moisture content of less than 1% by weight before introduction into the extruder.

3. The process as claimed in claim 1 which includes the step of drying the novolac resin to a moisture content of less than 0.3% by weight before introduction into the extruder.

4. The process as claimed in claim 1 in which the novolac resin is one that is formed with an excess of phenol.

5. The process as claimed in claim 1 in which the novolac resin has an average molecular weight within the range of 300–800.

6. The process as claimed in claim 1 in which the novolac resin has an average molecular weight within the range of 300–500.

7. The process as claimed in claim 1 in which the novolac resin has a melting point within the range of 90°–110° C.

8. The process as claimed in claim 1 in which the crosslinking agent is introduced in an amount within the range of 3–15% by weight of the resin.

9. The process as claimed in claim 1 in which the crosslinking agent is selected from the group consisting of hexamethylenetetramine, formaldehyde and cyclic formal.

10. The process as claimed in claim 1 in which the cure is carried out at a temperature within the range of 200°–300° C.

11. The process as claimed in claim 1 in which the cure is carried out at a temperature within the range of 100°–250° C.

12. The process as claimed in claim 1 in which the exposure to cure is for a time up to 10 minutes.

13. The process as claimed in claim 1 which includes the step in the formation of cured discontinuous fibers of engaging the stream of molten resin issuing from the spinnerette with a high velocity heated gaseous stream to attenuate the molten stream into discontinuous fibers, and collecting the discontinuous fibers as a web while being exposed to cure.

14. The process as claimed in claim 1 in which the ultrasonic vibrations are at 10,000–30,000 HZ.

15. The method for the continuous production of thermosetting resinous fibers comprising:

introducing a novolac resin into an extruder in which the novolac resin has a moisture content that does not exceed 1% by weight, introducing a cross linking agent into the extruder for admixture with the novolac resin, extruding the mixture at a temperature within the range of 95°–150° C., transporting the resinous material in a molten state directly from the extruder to a metering pump at a temperature within the range of 95°–150° C., conveying the molten resinous material under pressure from the metering pump to a spinnerette for issuance therefrom as a fibrous stream, forcing an inert gas through the wall of the spinnerette during passage of the molten resin therethrough to minimize contact between the wall of the spinnerette and the molten resin during passage of the molten resin therethrough, exposing the fibrous stream issuing from the spinnerette to cure in an atmosphere of a curing agent selected from the group consisting of an acid vapor of gas, formaldehyde and paraformaldehyde and mixtures thereof at a pressure within the range of 1–10 atmospheres for cure of the resinous fibers.

16. The process as claimed in claim 15 in which the wall of the orifice is formed of a sintered metal.

* * * * *